US005939987A

United States Patent [19]

Cram

[11] Patent Number: 5,939,987

[45] Date of Patent: Aug. 17, 1999

[54] ROADSIDE DEER WARNING METHOD AND SYSTEM

[76] Inventor: Randall S. Cram, 615 S. Shore Dr., Clear Lake, Iowa 50428

[21] Appl. No.: 09/013,717

[22] Filed: Jan. 26, 1998

[51] Int. Cl.[6] ..... G08B 23/00

[52] U.S. Cl. ..... 340/573.2; 340/691.1; 340/540; 116/22 A

[58] Field of Search ..... 340/573, 691, 340/693, 552, 541, 540, 573.2, 573.3, 691.1, 693.1; 116/22 A; 367/139

[56] References Cited

U.S. PATENT DOCUMENTS

| | | | |
|---|---|---|---|
| 4,503,399 | 3/1985 | Carr | 340/573 |
| 4,510,488 | 4/1985 | St. Jean et al. | 340/567 |
| 4,703,171 | 10/1987 | Kahl et al. | 250/221 |
| 4,853,678 | 8/1989 | Bishop, Jr. et al. | 340/573 |
| 4,982,176 | 1/1991 | Schwarz | 340/567 |
| 5,217,296 | 6/1993 | Tanner et al. | 362/183 |
| 5,220,309 | 6/1993 | Carder, Jr. | 340/573 |
| 5,266,807 | 11/1993 | Neiger | 250/353 |
| 5,418,518 | 5/1995 | Schenken et al. | 340/384.1 |
| 5,450,060 | 9/1995 | Parkhurst | 340/539 |
| 5,461,231 | 10/1995 | Sugimoto et al. | 250/342 |
| 5,473,311 | 12/1995 | Hoseit | 340/573 |
| 5,554,972 | 9/1996 | Brne | 340/552 |
| 5,602,523 | 2/1997 | Turchioe et al. | 340/384.2 |
| 5,604,483 | 2/1997 | Giangardella et al. | 340/565 |
| 5,627,518 | 5/1997 | Wishart | 340/573 |
| 5,726,629 | 3/1998 | Yu | 340/573 |
| 5,735,492 | 4/1998 | Pace | 246/125 |
| 5,760,686 | 6/1998 | Toman | 340/552 |
| 5,763,872 | 6/1998 | Ness | 250/214 AL |

*Primary Examiner*—Daniel J. Wu
*Assistant Examiner*—Anh La
*Attorney, Agent, or Firm*—Zarley, McKee, Thomte, Voorhees & Seas

[57] ABSTRACT

The present invention provides a warning system to motorists to notify them of the presence of deer or other large animals along a roadside, such that the motorists can slow down and drive cautiously to avoid an accident with the deer. The system includes a plurality of posts installed along the roadside, with each post having a motion detector for sensing the presence of deer. Each motion detector is operatively connected to a light which is activated when a deer enters the sensing zone of the motion detector. The lights and motion detectors may be connected to a 120 volt power supply or to a battery which is coupled to a solar panel for recharging. The lights may be electrically connected in series such that all the lights are illuminated when one motion detector senses a deer. Each motion detector may also be connected to a sound generating device to deter the deer from the roadside. A light-sensitive photoelectric eye may also be provided such that the devices are functional only at night.

22 Claims, 4 Drawing Sheets

ROADSIDE DEER WARNING METHOD AND SYSTEM

BACKGROUND OF THE INVENTION

Accidents involving cars or trucks striking deer or other large animals, result in millions of dollars of property damage and often times bodily injury each year. With increasing deer populations, these accidents are becoming more frequent. These accidents are most common in October, November and early December, when the deer are in rut, and in April, May, June for foaling. According to Iowa DOT statistics, the number of deer-related accidents in Iowa in 1996 was over 12,000, up approximately 3% from 1995.

Many devices have been tried in the past in an effort to scare or deter the deer away from roads, so as to reduce the number of such accidents. For example, whistles and reflectors have been used to scare the deer away. However, deer quickly adapt to such deterrent devices, which soon loose effectiveness. Fences have also been used, but only deter the deer to another road crossing location.

Accordingly, a primary objective of the present invention is the provision of a method and system for warning motorists of the presence of deer and other large animals near a road.

Another primary objective of the present invention is the provision of a series of motion detectors installed along a roadside to sense the presence of deer and then activate warning lights to notify approaching motorists of the potential danger.

These and other objectives will become apparent from the following description of the invention.

SUMMARY OF THE INVENTION

The present invention is directed towards a method and system for warning approaching motorists of the presence of a deer or other large animal near the roadside so that the motorists can drive with caution. The device includes a plurality of infrared motion detectors mounted on posts installed along a roadside, such as a highway. Each post also includes a lamp or light operatively connected to the motion detector. When the motion detector senses the presence of a deer or large animal, the light is illuminated, thereby warning or notifying approaching motorists of the deer's presence. The lights on adjacent posts may be electrically connected in series such that all the lights will be activated upon one motion detector sensing a deer or other large animal near the roadside. In a preferred embodiment, the lamps may include two different colored bulbs, such as red and yellow, such that the motion detector sensing the deer will activate the red bulb while the yellow bulbs are activated on the other posts. The posts may include solar panels to charge batteries so as to provide power to the motion detectors and the lights. Alternatively, the motion detectors and lights may be wired to an electrical power source.

DETAILED DESCRIPTION OF THE DRAWINGS

Figure 1:
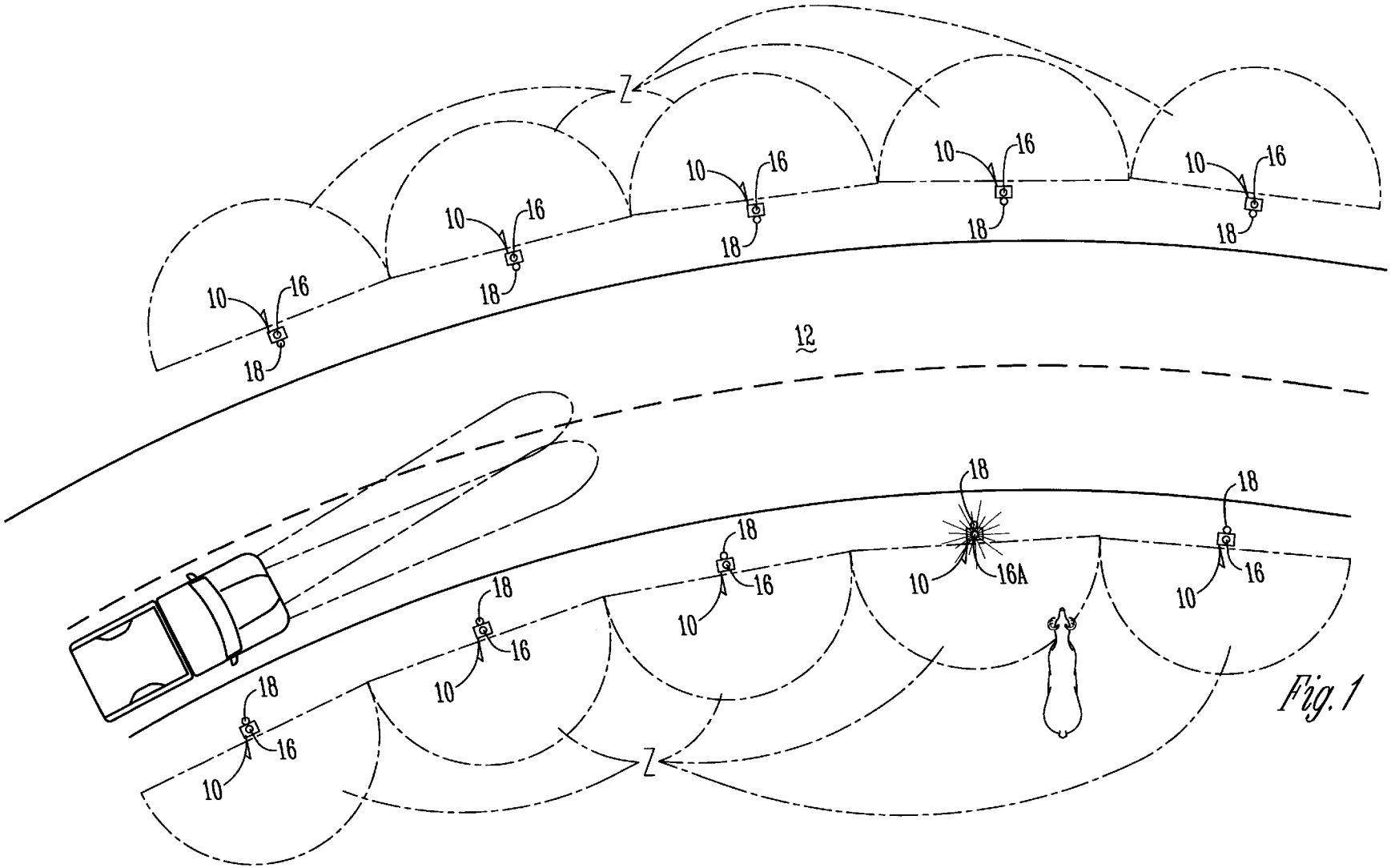
FIG. 1 is a top plan schematic view of the deer warning system of the present invention.
Figure 2:
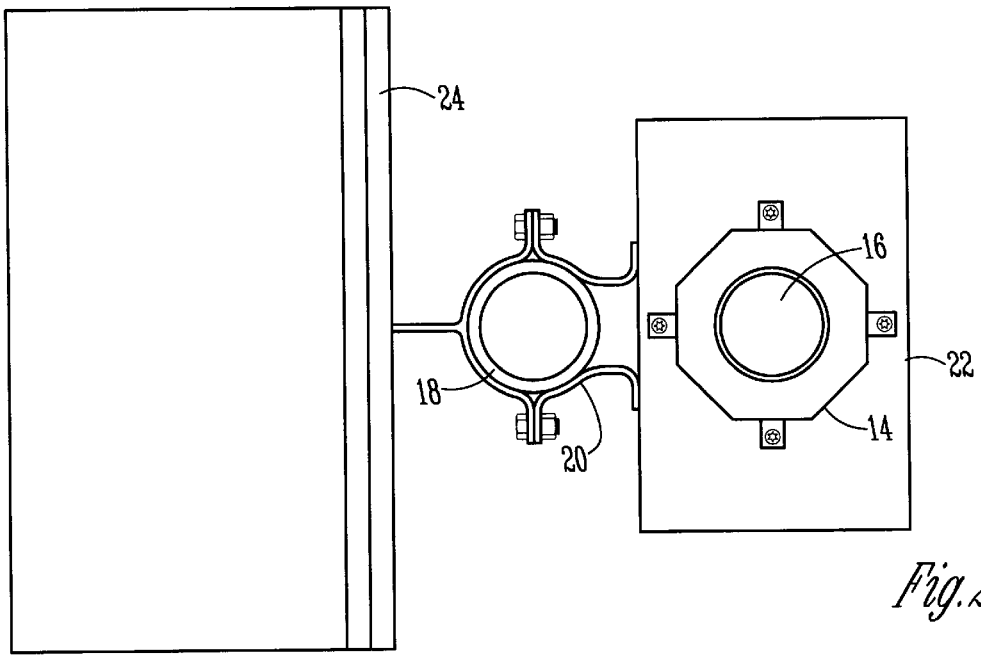
FIG. 2 is a top plan view of one device of the present invention, including the motion detector, light, and solar panel.

In accordance with the present invention, a plurality of devices 10 are positioned adjacent a roadside 12 to generate a warning signal to motorists when a deer or other large animal is near the roadside. More particularly, each device 10 includes a motion detector 14 and a light or lamp 16 mounted upon a post 18 installed along the roadside. A bracket 20 mounts the motion detector 14 and light 16 to the post 18. Preferably, the motion detectors 14 utilize infrared sensors which detect the presence of a deer within a zone Z adjacent the road 12. Each light 16 is electrically connected to the motion detector 14 such that upon sensing the presence of a deer within the zone Z, the light 16A is illuminated to warn an approaching motorist of the deer's presence. The light may be continuously illuminated or flashing when activated. The light 16 is mounted on top so as to be visible to drivers coming in both directions along the road.

Figure 3:
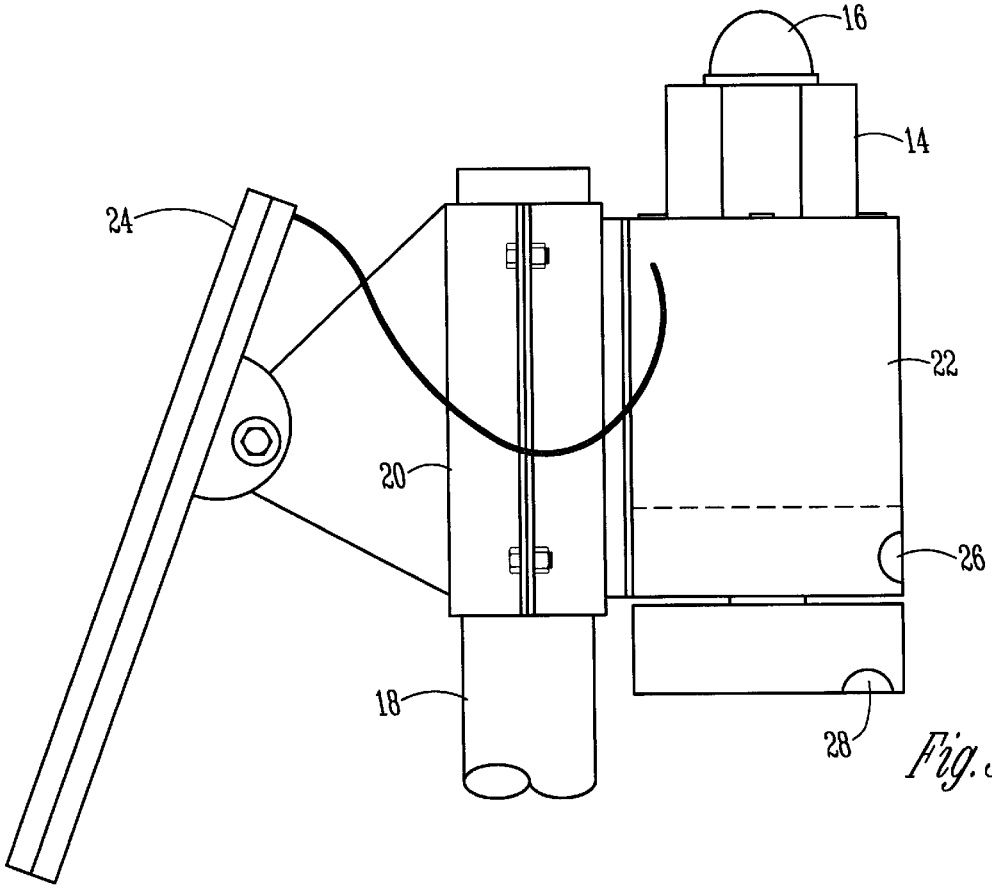
FIG. 3 is a side elevation view of the device of FIG. 2.

The motion detectors 14 and lights 16 may be hard wired to an electrical power source, or alternatively may be powered by a battery 22 operatively connected to a solar panel 24. The solar panel 24 is pivotally mounted to the post 18 by the bracket 20, as best seen in FIG. 3.

Each device 10 may include an optional variable frequency and intensity sound generator 26. The sound generator 26 is operatively connected to the motion detector 14 so as to emit a sound or noise audible to the deer to deter the deer from the roadside. Preferably, the sound generator 26 includes a microchip such that the audible frequency and intensity of the sound is varied so as to minimize adaptation by the deer to the sound. As a further option, each device 10 may include a light-sensitive photoelectric eye 28 such that the device is activated only at night when the deer are difficult or impossible to see along the roadside and/or to save battery life under solar power mode.

Figure 4:
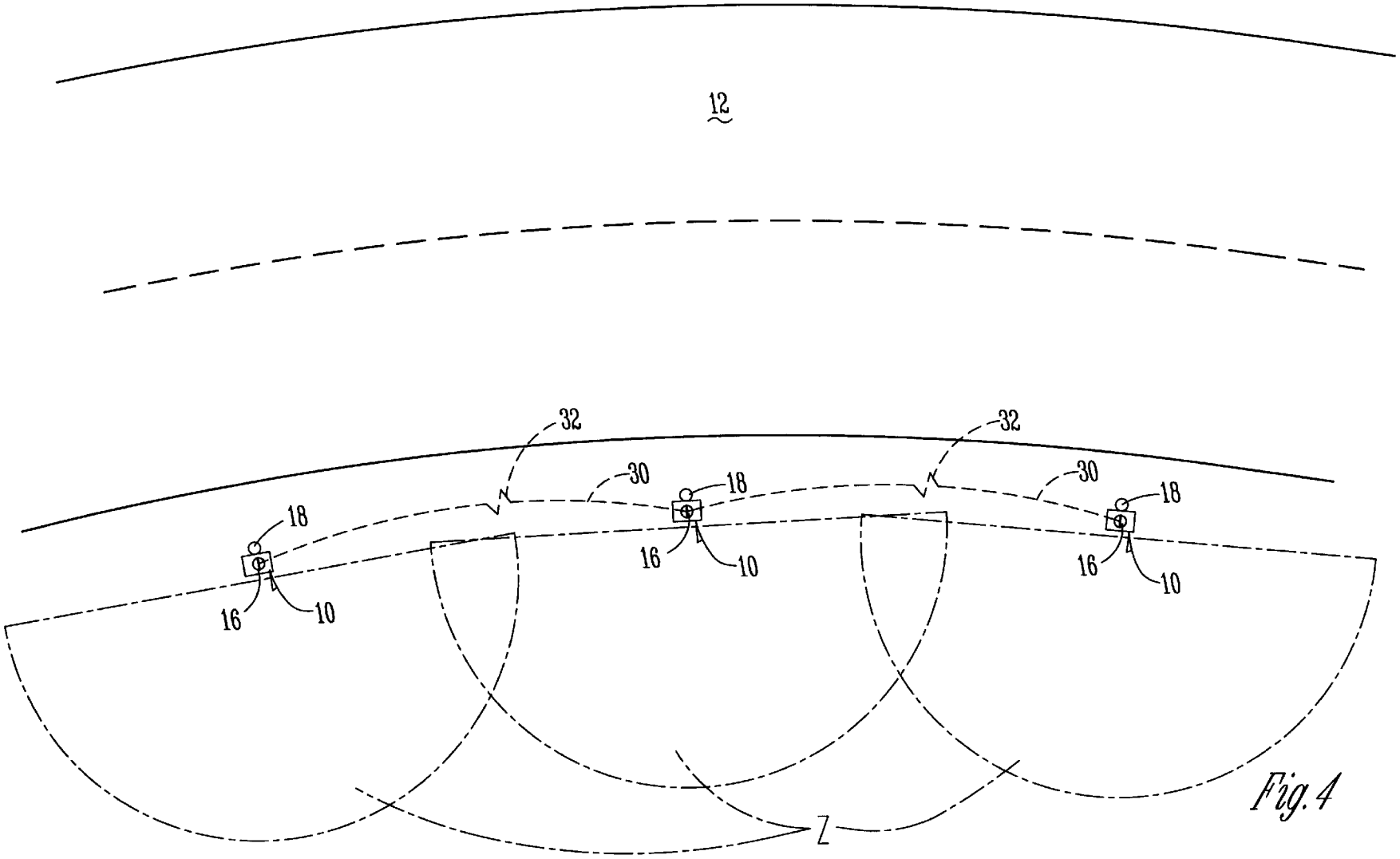
FIG. 4 is a schematic view of an alternative embodiment wherein the lights on each device are electrically connected in series.

In an alternative embodiment shown in FIG. 4, the lights 16 in the plurality of devices 10 are electrically connected in series, as indicated by line 30 and relay 32. Thus, if one motion detector 14 senses the presence of a deer, all the lights 16 will be activated to warn the approaching motorist. As a further refinement of this embodiment, each light 16 may include two different color bulbs, for example, red and yellow. The motion detector 14 which senses the deer will illuminate the directly connected red bulb, while the yellow bulbs of the other serially connected lights 16 will be illuminated. Thus, a warning signal to the driver will be provided along an extended portion of the roadway with the yellow bulbs, while pin pointing the location of the deer with the red bulb.

Figure 5:
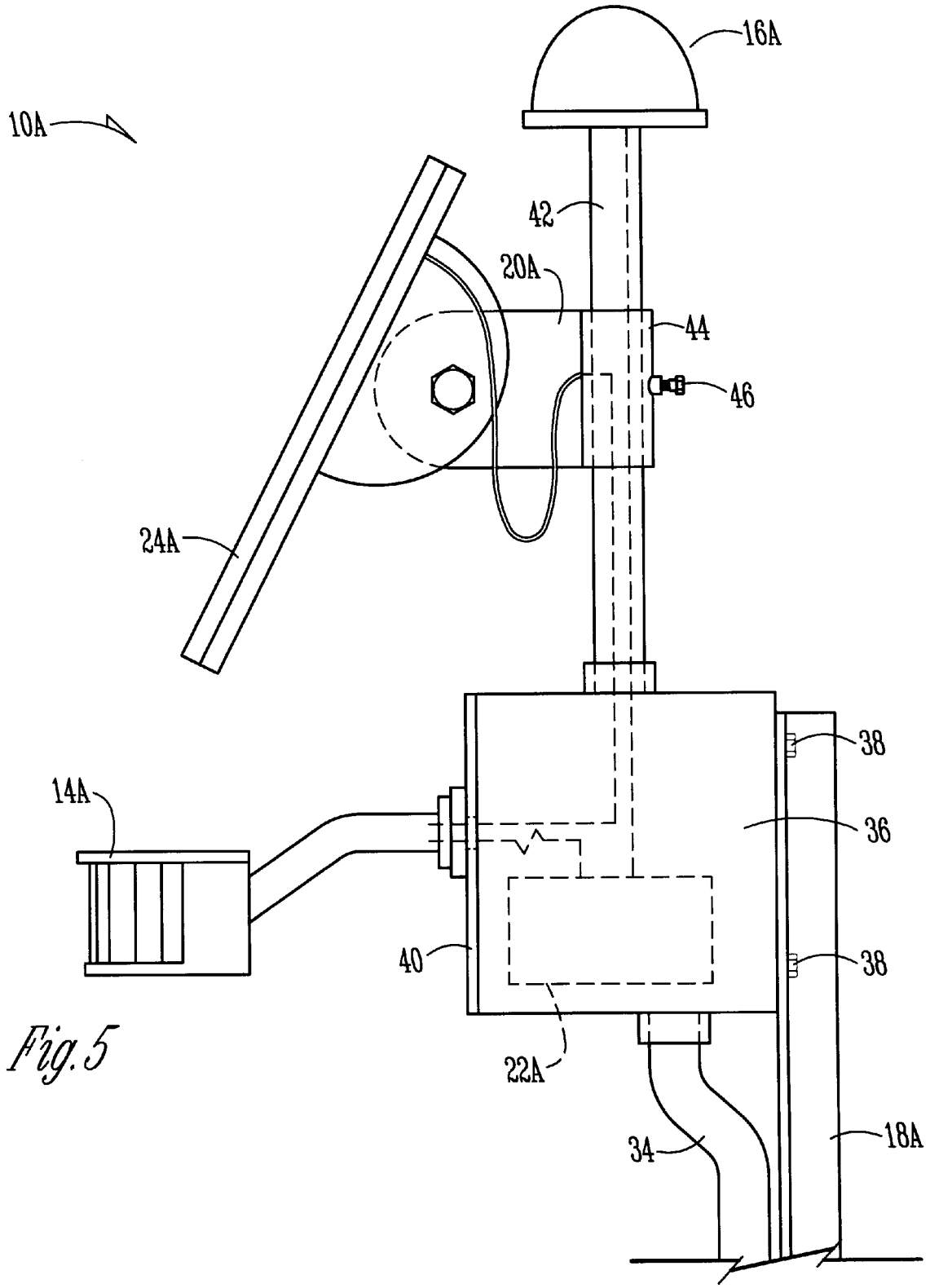
FIG. 5 is a side elevation view of an alternative embodiment, including an electrical power supply.

A further alternative device 10A is shown in FIG. 5. The device 10A is connected to a 120 volt power source. Often, such electrical power is supplied along roads for lights and signs.

More particularly, the device 10A is mounted on a post 18A which may be provided by the Department of Transportation. A ½" EMT conduit 34 is secured to the pipe 18A, with a standard galvanized metal electrical box 36 mounted on the top of the conduit 34. A motion detector 14A is mounted on the box 36 and is electrically connected to the 120 volt power source and/or to a rechargeable battery 22A housed within the box 36. The box 36 is preferably mounted to the post 18A using vandal-proof fasteners 38. The box 36 includes a gasketed removable cover 40. A pipe 42 extends upwardly from the box 36 to support a light 16A. Preferably, the light 16A is an amber flash unit operative from both the 120 volt power source and from the battery 22A. The light 16A is NEMA/UL rated for outdoor location. A solar panel 24A is pivotally mounted upon a bracket 20A, which includes a collar 40 rotatably mounted upon the post 38 such that the solar panel can be properly positioned relative to the sun. A set nut 46 extends through the collar 44 and engages the pipe 42 so as to maintain the solar panel 24A in the desired position.

As with the devices 10, a plurality of the devices 10A may be electrically connected in series such that activation of one motion detector 14A illuminates all of the lights 16A.

As an alternative to being wired in electrical series, the devices 10 and 10A may include a transmitter and receiver such that the activation of one light will cause a signal to be transmitted to the receiver of an adjacent light, thereby activating the adjacent lights in a wireless series. Another alternative embodiment substitutes a heat sensor for each motion detector, such that the body temperature of the deer will activate the light or lights.

With devices 10 and 10A positioned on both sides of the road 12, as shown in FIG. 1, drivers will know which side of the road to beware of, and can slow down so as to more easily avoid an accident with a deer.

As seen in FIG. 1, the devices 10 and 10A may be installed along the roadside such that the zones Z of each motion detector 14 are adjacent one another. The zones Z extend at least 180° and preferably approximately 210°. Alternatively, the devices 10 and 10A may be spaced closer together such that the zones Z partially overlap one another, as seen in FIG. 4.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A method of warning motorists of roadside deer, comprising:

installing a series of motion detectors and lamps operatively connected thereto along a roadside at locations of high deer concentrations or deer crossings;

sensing with one of the motion detectors the presence of deer within a zone along a road; and illuminating a lamp visible to an approaching motorist in response to the motion detector sensing the deer, thereby warning the motorist of the proximity of the deer.

2. The method of claim 1 wherein the lamp flashes on and off.

3. The method of claim 1 further comprising electrically connecting the lamps in series so that a series of lamps are illuminated in response to one motion detector sensing the presence of a deer.

4. The method of claim 1 wherein each lamp includes yellow and red bulbs, with the red bulb being activated by the associated motion detector and the yellow bulbs of adjacent lamps being electrically connected in series so as to illuminate all yellow bulbs when any one red bulb is illuminated.

5. The method of claim 1 further comprising providing power to the motion detector and lamp with a battery.

6. The method of claim 1 further comprising providing power to the motion detector and lamp with a solar panel.

7. A method of alerting motorists to the presence of animals which cause accidents on roads, the method comprising:

sensing the presence of an animal along a road, and activating a light in response to sensing the animal, the light being installed on the side of the road and sufficiently large and bright to be seen by an approaching motorist.

8. The method of claim 7 wherein the light is normally off unless the motion detector senses an animal.

9. The method of claim 7 wherein the light is flashing.

10. The method of claim 7 wherein the light is solar powered.

11. The method of claim 7 wherein a plurality of lights in electrical series are activated upon sensing of an animal by one of a plurality of animal detectors.

12. The method of claim 11 wherein each light has a pair of different color bulbs, and each light is operatively connected to one of the detectors.

13. The method of claim 12 wherein the one detector which senses the animal activates the first color bulb of the connected light and electrical relays activate the second color bulbs of the other lights.

14. The system for warning motorists of deer, comprising:

a plurality of detectors installable along a roadside;

a plurality of lights, each being operatively connected to one of the detectors so as to be activated when the connected detector senses a deer along the roadside, the lights being sufficiently bright to warn an approaching motorist of the presence of the deer.

15. The system of claim 14 wherein each light is a flashing light.

16. The system of claim 14 wherein each detector is an infrared motion detector.

17. The system of claim 14 wherein the lights are electrically connected in series so that all the lights are lit in response to any one of the detectors sensing a deer.

18. The system of claim 17 wherein each of the lights includes two differently colored bulbs, with the first colored bulb being lit when the connected detector senses a deer and the second colored bulb being lit when another detector senses a deer.

19. The system of claim 14 further comprising a plurality of audible signals each being operatively connected to one of the detectors so as to be activated when the connected detector senses a deer.

20. The system of claim 14 further comprising a light sensor operatively connected to each detector for activating the detector only at night.

21. A method of alerting motorists to the presence of animals which cause accidents on roads, the method comprising:

sensing the presence of an animal along the road with one of a plurality of animal detectors;

wherein each detector is operatively connected to a light having a pair of different colored bulbs;

activating the first color bulb of the light; and activating, through electrical relays, the second color bulb in the remaining lights, all of the lights being connected in electrical series.

22. The method of claim 21 wherein the lights are installed on the side of the road.

* * * * *